United States Patent [19]

Titolo

[11] Patent Number: 4,662,324

[45] Date of Patent: May 5, 1987

[54] OLEODYNAMIC VALVE, PARTICULARLY FOR A HYDRAULIC TAPPET

[75] Inventor: Andrea Titolo, Turin, Italy

[73] Assignee: Fiat Auto S.p.A., Turin, Italy

[21] Appl. No.: 790,017

[22] Filed: Oct. 22, 1985

[30] Foreign Application Priority Data

Oct. 25, 1984 [IT] Italy ..... 53964/84[U]

[51] Int. Cl.[4] ..... F01L 1/24

[52] U.S. Cl. ..... 123/90.56; 123/90.55

[58] Field of Search ..... 123/90.55, 90.56, 90.46, 123/90.57

[56] References Cited

U.S. PATENT DOCUMENTS

| | | | |
|---|---|---|---|
| Re. 21,931 | 10/1941 | Voorhies et al. | 123/90.56 |
| 1,966,794 | 7/1934 | George | 123/90.55 |
| 1,977,778 | 10/1934 | Rice | 123/90.55 |
| 2,370,761 | 3/1945 | Voorhies | 123/90.56 |
| 2,940,433 | 6/1960 | Randol | 123/90.55 |
| 3,728,990 | 4/1973 | Lampredi et al. | 123/90.56 |
| 4,279,226 | 7/1981 | Lampredi et al. | 123/90.56 |
| 4,463,713 | 8/1984 | Banale | 123/90.56 |

FOREIGN PATENT DOCUMENTS 2350599 4/1975 Fed. Rep. of Germany ... 123/90.55

*Primary Examiner*—Ira S. Lazarus

*Attorney, Agent, or Firm*—Sughrue, Mion, Zinn, Macpeak & Seas

[57] ABSTRACT

In a hydraulic tappet including two cups slidable one within the other, of which the outer one cooperates with the surface of the cam of the camshaft through an adjustment disc while the inner one bears on the end of the valve stem, an expansion chamber is defined between the facing frontal walls of the two cups and is connected to the lubrication circuit of the engine through a supply duct controlled by an oleodynamic valve. The valve is constituted by a conical seat formed in a through-hole in the frontal wall of the inner cup to connect the expansion chamber to the lower part of the cup and intercept the supply duct, and a mushroom-shaped member whose head controls the conical seat and whose stem is inserted in the through-hole which acts as a guide for it.

2 Claims, 2 Drawing Figures

OLEODYNAMIC VALVE, PARTICULARLY FOR A HYDRAULIC TAPPET

The present invention relates to an oleodynamic valve, particularly for a hydraulic tappet with automatic clearance recovery.

According to current technology, in order to save on engine maintenance and avoid high noise levels in the timing system, use is made of hydraulic tappets which are provided with automatic clearance recovery and which largely fulfil the task.

Tappets of this type presently in use effect the clearance recovery by means of a chamber between two cups which slide one within the other and of which the first cooperates with the surface of the cam, with the interposition of an adjustment disc, and the second bears on the valve stem.

The chamber is connected through an oleodynamic valve to the oil under pressure in the lubrication circuit so that, by expanding, it keeps the two cups in constant contact with the respective surfaces of the cam and the stem.

The oleodynamic valve in question is constituted by a ball which is placed in a conical duct opening into the chamber and is operated by the flow of pressurised oil from the lubrication circuit.

A disadvantage found in valves of this type lies in the fact that, if the pressure difference exerted by the two parts, the delivery and the chamber, is rather low, delays in closure may occur at high rates of rotation and cause noise and loss of efficiency due to the imperfect adjustment of the cam-tappet clearance.

The object of the present invention is to provide an oleodynamic valve for the aforesaid use which does not have this type of disadvantage.

This object is achieved by means of an oleodynamic valve, particularly for a hydraulic tappet of the type including two cups slidable one within the other, of which the outer one cooperates with the surface of the cam of the camshaft through an adjustment disc while the inner one bears on the end of the valve stem; an expansion chamber defined between the facing frontal walls of the two cups and connected to the lubrication circuit of the engine through a supply duct controlled by the valve which is characterised in that it is constituted by a conical seat formed in a through-hole in the frontal wall of the inner cup to connect the expansion chamber with the lower part of the cup and intercept the supply duct, and by a mushroom-shaped member whose head controls the conical seat and whose stem is inserted in the through-hole which acts as a guide for it.

Figure 1:
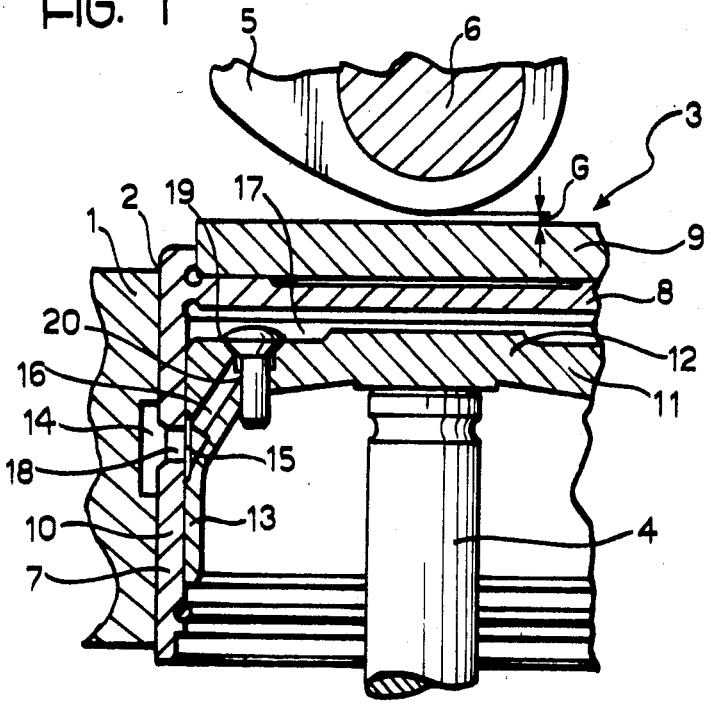
Figure 2:
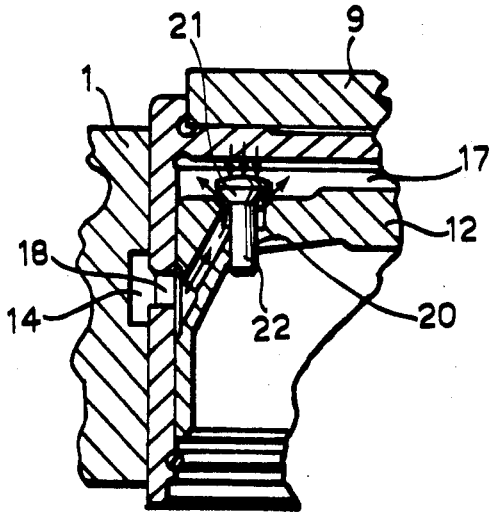

Further characteristics and advantages will become clearer from the description which follows with reference to the appended drawings, provided purely by way of non-limiting example, in which:

FIG. 1 is a partial axial section of a hydraulic tappet including a valve according to the invention, and FIG. 2 is a partial axial section similar to FIG. 1, in which the valve according to the invention is shown in a raised position.

With reference to the drawing, there is shown the head 1 of an internal combustion engine in which are formed cylindrical seats 2 in each of which is slidable a hydraulic tappet, generally indicated 3. Each hydraulic tappet 3 is interposed between the stem 4 of a valve and one of the cams 5 of a camshaft 6 in the head. A cup 7 is slidable in the cylindrical seat 2 and has a frontal wall 8, on which the cam 5 rests with the interposition of a cylindrical adjustment pad 9, and a cylindrical side wall 10. A second cup 11 is slidable in the cup 7 and also has a frontal wall 6 which bears on the stem 4 of the valve and a cylindrical side wall 13. An annular groove 14 is formed in the side wall of the cylindrical seat 2 and connects it with the lubrication circuit of the engine. An annular groove 15 is formed in the side wall 13 of the cup 11 and communicates through a supply duct 16 with an expansion chamber 17 defined by the facing frontal walls 8 and 12.

A ring of radial holes 18 formed in the side wall 9 of the cup 7 puts the two annular grooves 13 and 15 into communication with each other.

The duct 16 is controlled by an oleodynamic valve which, among other things, has a conical seat 19 formed at the opening of a through-hole 20 formed in the frontal wall 12 and putting the expansion chamber 17 into communication with the cylindrical seat 2.

In the through-hole 20 is inserted a mushroom-shaped member having a conical head 21 with an upper rounded surface adapted to cooperate with the seat 19 and a cylindrical stem 22 adapted to slide in the through-hole 20 which acts as a sliding guide for it.

OPERATION

As will easily be deduced from the drawings, the pressurised oil of the supply circuit which is in the annular groove 14 when the tappet is in the rest position (see FIG. 1) passes through the radial hole 18, the annular groove 15 and the duct 16, raises the mushroom-shaped member, and enters the chamber 17 to cause its expansion and the consequent upward thrust of the cup 7, thus restoring the clearance G shown in FIG. 1.

When the cam rotates and thrusts the cup 7 downwardly, the pressure which is created in the chamber 17 thrusts the mushroom-shaped member downwardly and the latter bears on the seat 19 to close the oil passage, so that the volume of the chamber 17 no longer changes and the cam can act on the valve stem.

The closure of the valve is facilitated by the fact that the difference between the areas subject to pressure is considerable, whereby the shaft 22 is not subject to upward thrusts since the space within the cylindrical seat 2 is practically unpressurised.

Moreover, the fact that the head of the mushroom-shaped member has a rounded upper surface prevents the member itself from remaining stuck to the upper wall because of adhesion phenomena.

I claim:

1. An oleodynamic valve for a hydraulic tappet of the type including an adjustment disc and two cups slidable one within the other, the outermost of said cups being intended to cooperate with a surface of a cam of a camshaft through the adjustment disc and the innermost of said cups being intended to bear on an end of a valve stem, the cups having facing frontal walls defining an expansion chamber therebetween and one of the cups defining a supply duct which is controlled by said valve and is intended to connect the expansion chamber to a pressurized lubrication circuit of an engine, wherein said valve comprises a through-hole formed in the frontal wall of the inner cup to connect the expansion chamber to the lower unpressurized part of the cup and intercept the supply duct, a conical seat defined by said through-hole, and a mushroom-shaped member having a head which controls the conical seat and a stem which is inserted in the through-hole which acts as a sliding guide for the stem.

2. An oleodynamic valve as defined in claim 1, herein the head of the mushroom-shaped member has a rounded upper surface.

* * * * *